United States Patent [19]

Murdoch

[11] Patent Number: 4,527,843

[45] Date of Patent: Jul. 9, 1985

[54] BED PAN AND URINE BOTTLE WASHING AND DISINFECTING MACHINES

[75] Inventor: George Murdoch, Andover, England

[73] Assignee: Avon Murdoch Limited, Bristol, England

[21] Appl. No.: 333,891

[22] Filed: Dec. 23, 1981

[30] Foreign Application Priority Data

Jan. 2, 1981 [GB] United Kingdom ..... 8100015
Aug. 17, 1981 [GB] United Kingdom ..... 8125060

[51] Int. Cl.[3] ..... E05F 11/54; A47B 81/00

[52] U.S. Cl. ..... 312/31.2; 49/352; 49/360; 312/138 R; 312/312

[58] Field of Search ..... 312/283, 31, 31.01, 312/312, 31.2, 138 R, 138 A; 49/231, 360, 352

[56] References Cited

U.S. PATENT DOCUMENTS

| | | | |
|---|---|---|---|
| 620,006 | 2/1899 | Williams | 49/360 |
| 1,549,203 | 8/1925 | McClure | 49/360 |
| 1,652,186 | 12/1927 | Strauss | 49/360 |
| 1,687,147 | 10/1928 | Sawyer | 49/360 |
| 1,888,612 | 11/1932 | Anderson | 49/360 |
| 1,916,579 | 7/1933 | Mosher | 49/352 |
| 2,270,484 | 1/1942 | Wallerius | 49/360 |
| 2,843,375 | 7/1958 | Lesage | 49/360 |
| 3,214,801 | 11/1965 | Nachtsheim | 49/360 |
| 3,281,991 | 11/1966 | Colell | 49/352 |
| 3,714,737 | 2/1973 | Fillion et al. | 49/360 |

FOREIGN PATENT DOCUMENTS

| | | | |
|---|---|---|---|
| 1584250 | 3/1970 | Fed. Rep. of Germany | 49/360 |
| 8122304 | 7/1981 | Fed. Rep. of Germany . | |
| 602202 | 7/1978 | Switzerland . | |

*Primary Examiner*—Francis K. Zugel
*Assistant Examiner*—Thomas A. Rendos
*Attorney, Agent, or Firm*—Pearne, Gordon, Sessions, McCoy, Granger & Tilberry

[57] ABSTRACT

A bed pan washing and disinfecting machine has a cradle mounted on a transverse shaft in a washing chamber of the machine, the cradle having an upper part to receive a bed pan in a substantially horizontal orientation and a lower part to receive a urine bottle substantially in the orientation of use so that there is no spillage during loading. After loading of the bed pan and urine bottle and closure of a door of the machine, the shaft is rotated clockwise through 110° to rotate the cradle and thus to empty the bed pan and urine bottle within the washing chamber. Cold water flushes the bed pan contents through a water trap of the machine, hot water washes the bed pan and urine bottle, and a steam cycle washes and disinfects the bed pan and urine bottle before the cradle is rotated back to its original position. The door of the machine may be a wedge-shaped vertically slidable door which on movement to a closed position effects, with the inter-position of a resilient sealing member, a seal against flanges of wall portions of the washing chamber around an access opening in a wall of the washing chamber.

2 Claims, 20 Drawing Figures

FIG.7
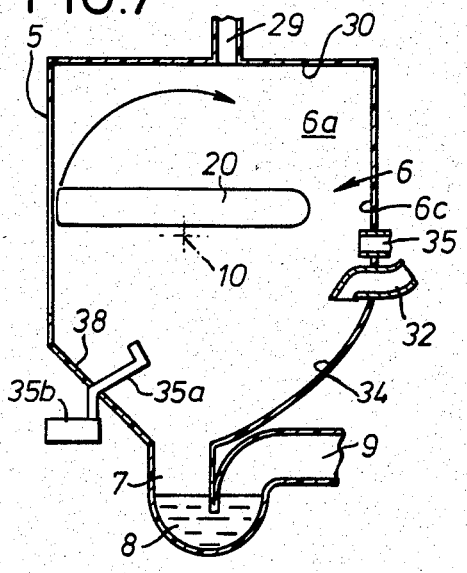
FIG.8
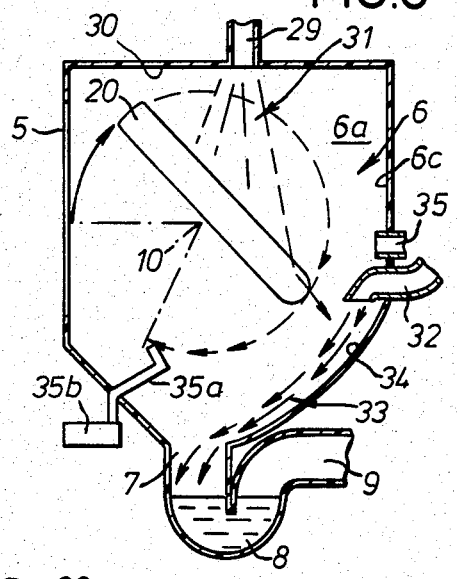
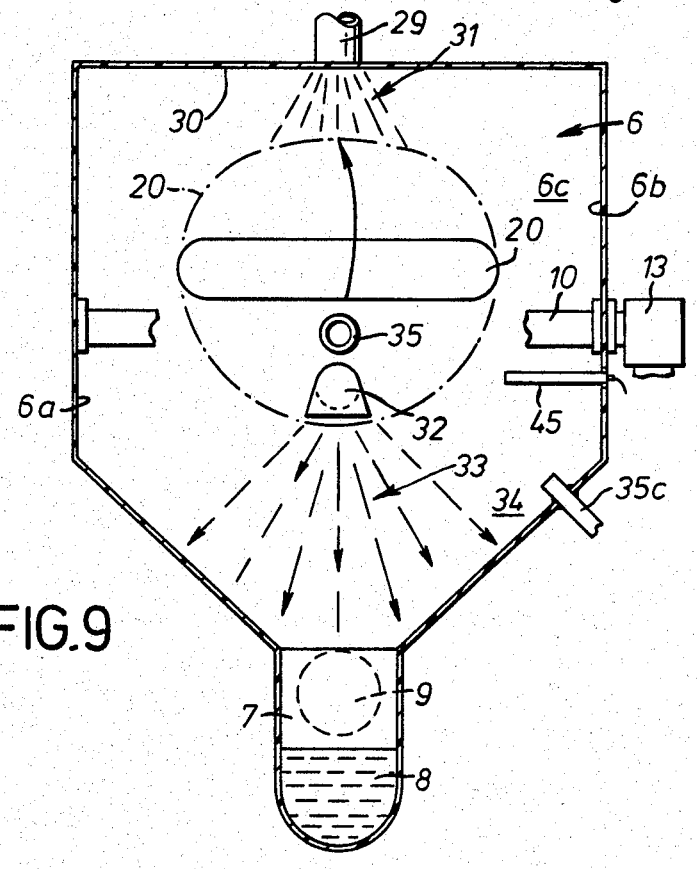
FIG.9

FIG. 10
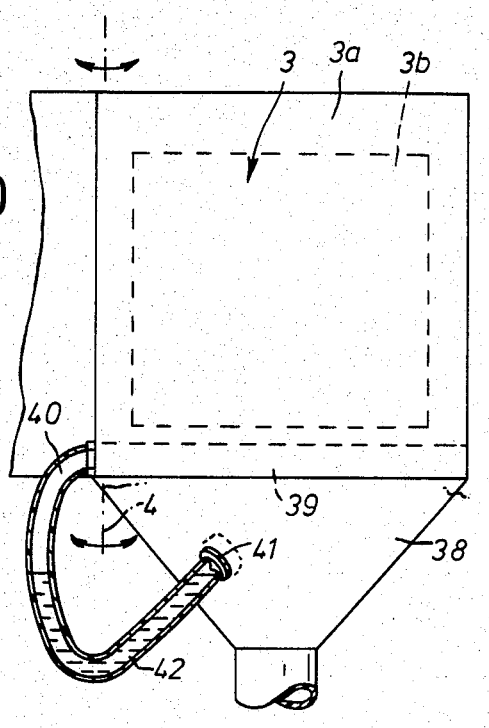
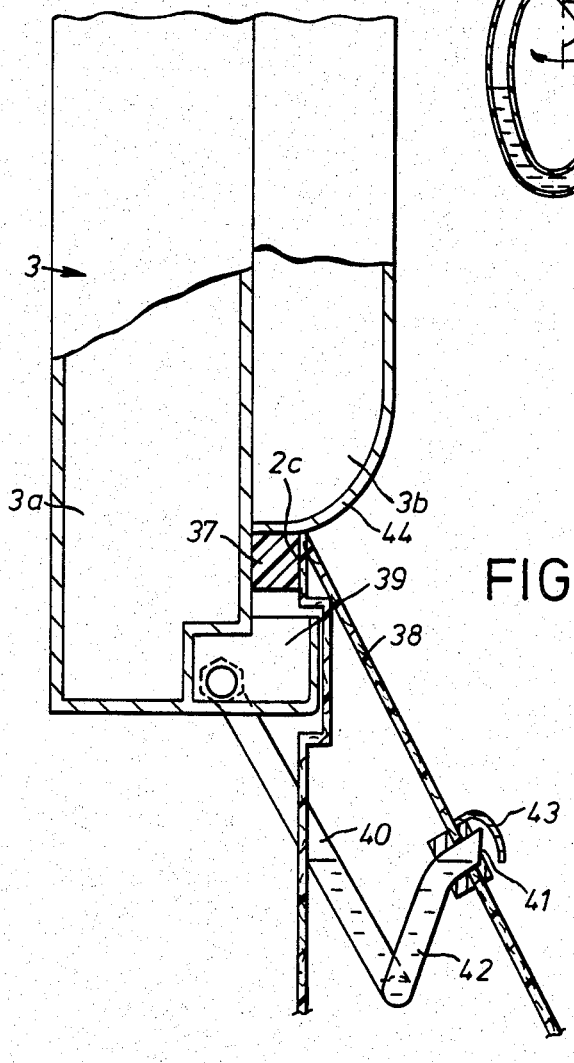
FIG. 11

FIG.16
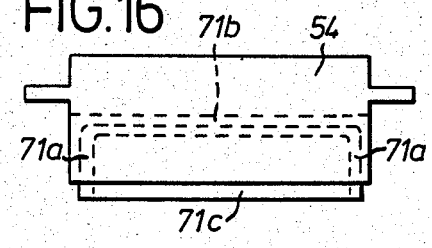
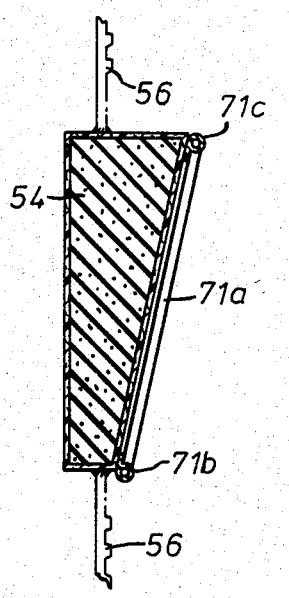
FIG.17
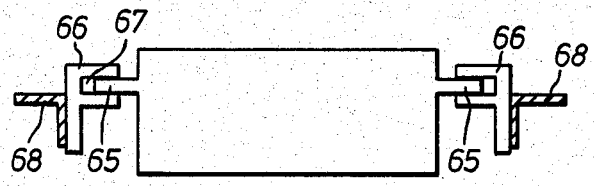
FIG. 18
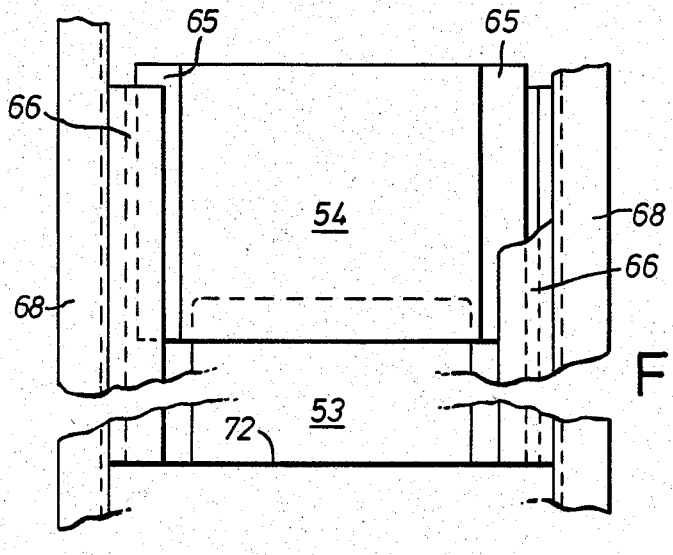
FIG. 19
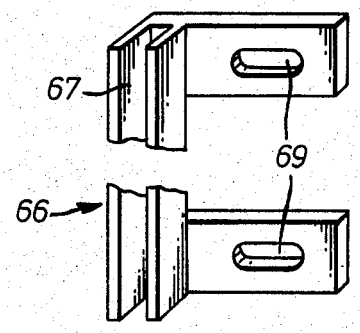
FIG. 20

BED PAN AND URINE BOTTLE WASHING AND DISINFECTING MACHINES

The invention relates to bed pan and urine bottle washing and disinfecting machines.

Such machines are widely used in hospitals and nursing homes. Existing machines of this kind can be divided into two kinds, front loading machines where a door opens downwards towards the operator to reveal an aperture in the front of the machine and top loading machines where the door is in the form of a lid and opens upwards away from the operator to reveal an aperture in the top of the machine, usually at about operator waist level. Machines can be either wall mounted or free standing.

Machines may be mere washing machines and effect a cold wash followed by a hot wash or may in addition use steam to effect steam disinfection. The steam may come from a main steam supply or from a steam generating unit within the machine.

In front loading machines the door in the open position slopes downwardly towards the machine and a cradle is provided on the door, into which cradle the operator loads a bed pan after use thereof by a patient before raising the door to a vertical closed position. Spillage is likely to occur during loading and as the door is closed and before it is fully closed, the contents of the bed pan empty into the machine, such loading and closing of the door, even if there is no spillage, almost certainly resulting in contamination of the operator either directly or by airborne bacteria. If urine bottles are also to be emptied and washed then these must be manually tipped to empty them into the machine and then, in the inverted position, placed over washing jets within the washing chamber of the machine. In addition to the likelihood of contamination by airborne bacteria, there is also risk of contamination by splashing and the loading and emptying operations are unpleasant for the operator due to the sight and sound of the bed pans and urine bottles being emptied and the odour emanating therefrom. Manual closing of the door and manual operation of a start control for the machine causes the contamination on the operator's hands to be transferred to the external surfaces of the machine with risk to health of patients, other nursing staff and engineering maintenance staff.

In previously proposed top loading machines, bed pans or urine bottles are engaged in spring clips on a rotatable cranked pipe and are moved during washing by rotation of the cranked pipe. Different cranked pipes with different clips thereon may be required depending on whether bed pans or urine bottles are to be washed, bed pans after use are not easy to engage with the clips, urine bottles must be emptied into the machine before engagement with the clips and engagement with the clips must be effected by an operator leaning over the machine and thus exposed to odour and bacteria from the used bottles and bed pans.

Previously proposed machines have been found to be unsatisfactory in that a water trap at a lower part of the machine and leading to a discharge waste pipe has been found to be prone to clogging since the run-off water from jets directed at the bed pans and urine bottles is not supplied at a sufficient rate to ensure that solid matter, including toilet paper and paper covers for bed pans, is carried through the trap and into the waste pipe. Flooding from machines with blocked waste traps has occurred on a number of occasions and the subsequent cleaning-up and unblocking operations and disinfecting of contaminated areas has proved very costly.

Where steam disinfection is a feature of the machine, it is important that a disinfection temperature of 80° C. is achieved and maintained for one minute to kill bacteria and even more important that if such a disinfection temperature has not been achieved that this fact is apparent. Nursing staff do not however have time to stand and monitor operation of a machine to ensure that a disinfection temperature indicating light is illuminated. Further, use of a bed pan thought to have been disinfected but in fact, due to malfunction of the machine, still being contaminated can have very dangerous cross-infection results.

The invention has among its objects to provide a bed pan and urine bottle washing and disinfecting machine which avoids the above mentioned disadvantages of previously proposed machines.

According to one aspect of the invention there is provided a bed pan and urine bottle washing and disinfecting machine having a wash chamber therein in which is mounted a cradle which can accept, in an orientation which is substantially the orientation of use, at least one bed pan and at least one urine bottle simultaneously, a door to close a loading aperture providing access to the washing chamber and a drive motor, energisable, subsequent to closing of the door, to rotate the cradle from an initial loading orientation to a washing orientation through an angle in excess of 90° thereby to empty the bed pan and urine bottle within the machine, and washing and disinfecting means to wash and disinfect the empty bed pan and urine bottle within the wash chamber of the machine before the bed pan and urine bottle are unloaded after being rotated back to the loading orientation.

The cradle may be so shaped that it can accept one or two bed pans at an upper position and up to six urine bottles at a position below the level at which the one or two bed pans are accepted.

Preferably the cradle is rotated through an angle of 110°.

Advantageously, during the rotation of the cradle or subsequent thereto, a dropped water flushing system is activated to effect washing with cold water falling from a header storage tank of the machine, the dropped water flushing system forceably flushing the contents of a trap of the machine into a waste pipe.

The cradle may be so shaped that it can also or alternatively accept other bowls and utensils requiring emptying, washing and disinfecting.

The cradle is advantageously mounted on an axle mounted in bearings and the drive motor is a reversible drive motor mounted externally of the chamber.

For economy and ease of maintenance a cabinet of the machine and/or the washing chamber thereof is preferably formed of fibreglass or a glass reinforced plastics material.

Subsequent to the cold dropped water flushing of the washing chamber, hot water can be pumped into the chamber through nozzles to effect washing of the bed pan and the urine bottle. The machine may include a nozzle in the chamber through which steam can be pumped from a steam main or from a steam generator of the machine to raise the bed pan and the urine bottle to a temperature in excess of 80° C., thereby to effect disinfecting thereof. A temperature sensor is preferably provided in the washing chamber and an alarm circuit is coupled thereto to give an indication if the temperature during the disinfecting operation is not maintained at at least 80° C. for a determined period. The alarm circuit, when operated, can prevent the door of the machine being opened at the end of a cycle of operation of the machine.

According to another aspect of the invention there is provided a bed pan and urine bottle washing and disinfecting machine having a door to close an opening providing access to the interior of a washing chamber of the machine, the door being slidably mounted for movement in a substantially vertical plane, and sealing means being provided to seal the door around the access opening as the door moves into a closed position.

Preferably the door is coupled to a motor for effecting opening and closing operations.

Advantageously the door is coupled to the motor by means of toothed belts which extend over toothed pulleys mounted on a drive shaft and also over idler pulleys, each belt having its opposite ends connected to the top and bottom of the door. The drive shaft is preferably coupled to the motor by way of a worm and a wheel arrangement.

The door is preferably generally wedge-shaped with the lower edge of the door of lesser thickness than the upper edge of the door such that, as the door moves into the closed position, the wedge-shape thereof causes sealing by the sealing means.

The door can be slidably mounted in guide rails provided at positions laterally of the door with the guide rails substantially vertical, the inner face of the door slopes downwardly outwardly and flanges formed by wall portions of the washing chamber of the machine at positions laterally of the access opening slope downwardly outwardly with the same angle of inclination as the inner face of the door.

Advantageously the sealing means includes a resilient sealing member provided on the door, which sealing member, at the location of the underside edge of the door, engages a face defining a lower edge of the access opening as the door moves into the closed position. Said face defining the lower edge of the access opening is preferably formed as a sill which slopes downwardly towards the interior of the washing chamber so that any condensation dripping from the door as it is opened or while it is in an open position, is drained from the sill into the washing chamber of the machine.

The invention is diagrammatically illustrated by way of example in the accompanying drawings, in which:

FIG. 7 is a schematic side view of the washing chamber of the machine of FIGS. 1 to 6 in an initial condition of a cycle of operation of the machine;

FIG. 8 is a view similar to FIG. 7 at a later stage in operation of the cycle of the machine;

FIG. 9 is a schematic front view of the washing chamber showing the path in operation of cold dropped water flushes;

FIG. 10 is a fragmentary schematic view showing the door of the machine in a closed position;

FIG. 11 is a sectional side view corresponding to FIG. 10;

FIGS. 15, 16 and 17 show the door of FIGS. 13 and 14 respectively in front elevation, plan view and sectional side view;

FIGS. 18 and 19 are respectively a plan view and front elevation showing details of the door construction and location; and FIG. 20 shows a guide rail for the door.

Figure 1:
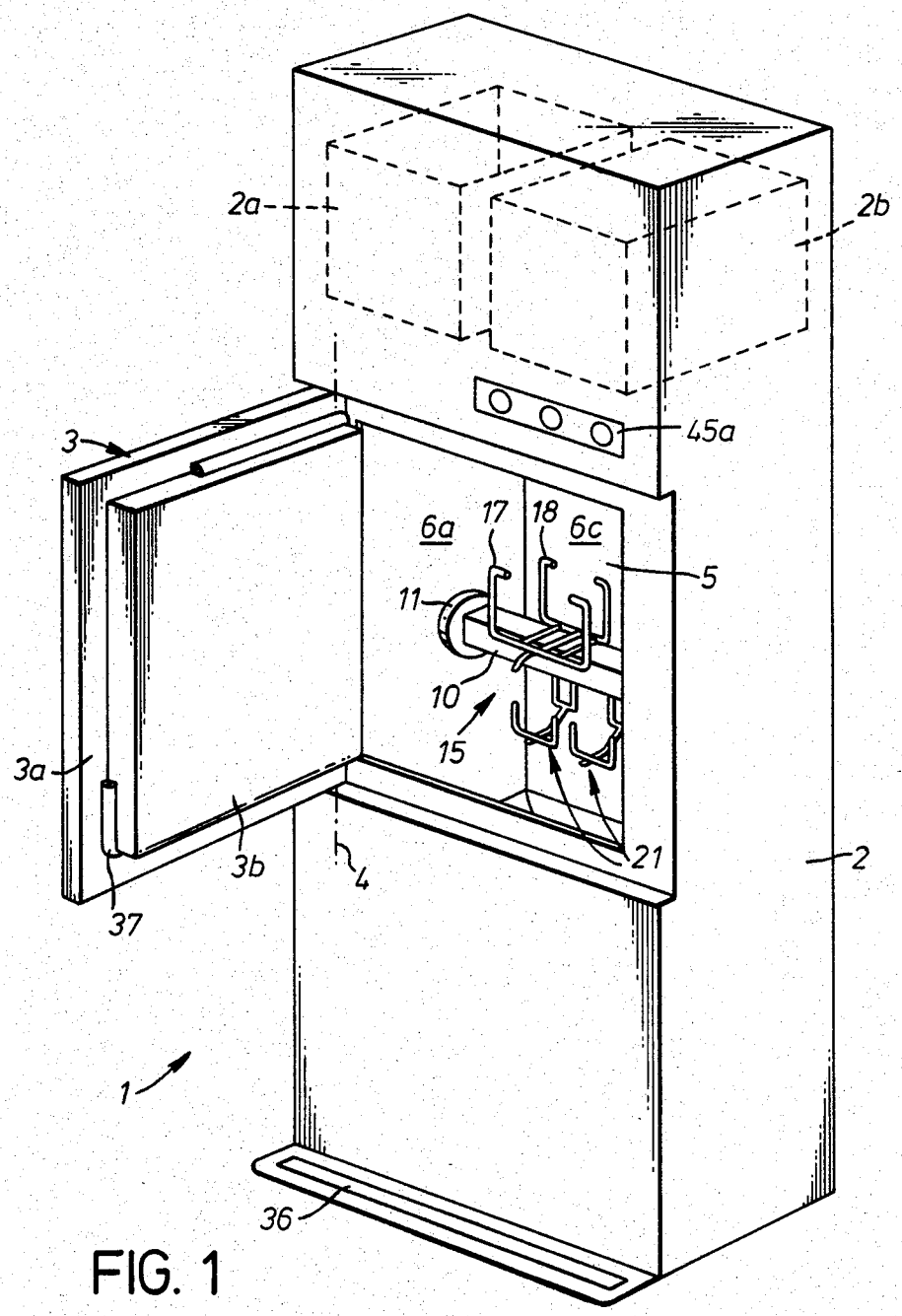
FIG. 1 is a perspective view of a first embodiment of a bed pan and urine bottle washing and disinfecting machine according to the invention comprising a front loading machine with a door openable to allow access to a washing and disinfecting chamber.

Referring to the drawings and firstly to FIG. 1, a bed pan and urine bottle washing and disinfecting machine generally indicated at 1 comprises a cabinet 2 with a door 3 pivotally mounted on a front wall of the cabinet 2 for movement about a vertical axis 4 between a closed position and the open position shown. With the door in the open position shown, access is obtained through an opening 5 to the interior of a washing chamber 6 of the machine, the washing chamber 6 having, as shown in FIGS. 7 to 9, an upper part which is generally rectangular in horizontal section and a lower part which tapers downwardly to an outlet pipe 7 with a water trap 8 therein and connected to a waste discharge pipe 9.

Preferably the cabinet 2, the door 3 and the washing chamber 6 are formed of a chemically resistant fibreglass or glass reinforced plastics material, which material is both cheaper and lighter than the conventionally used stainless steel and also requires less maintenance to keep it in a presentable condition.

Figure 2:
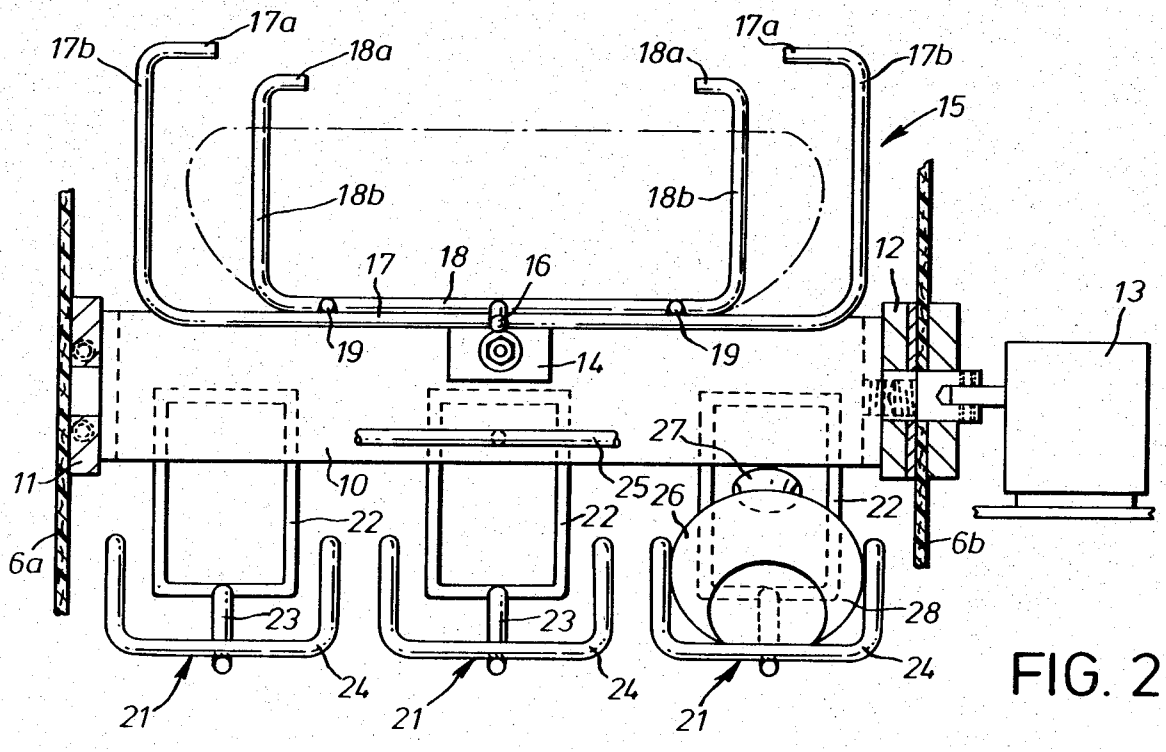
FIG. 2 shows a cradle mounted on a rotatable shaft of the machine of FIG. 1 in an initial loading orientation as seen by the operator when the door of the machine is open.
Figure 3:
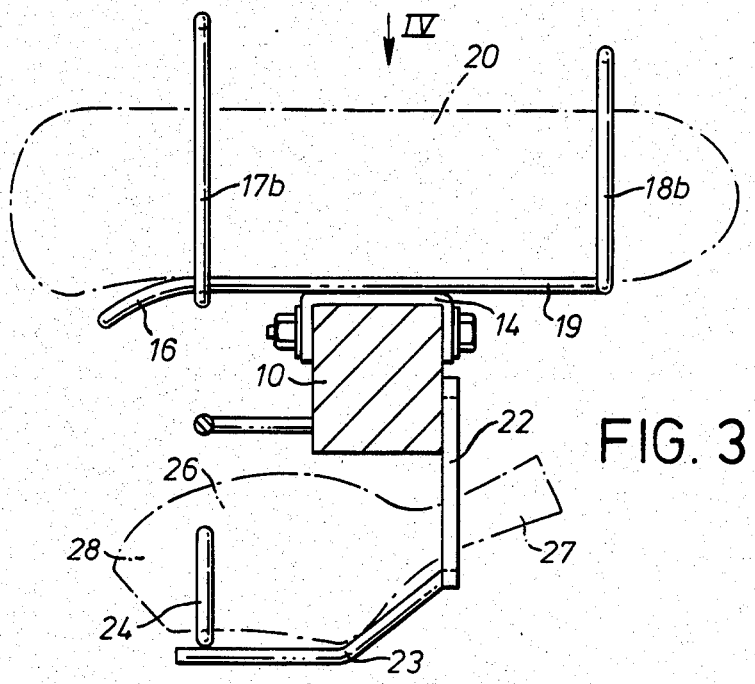
FIG. 3 is a side view corresponding to FIG. 2.
Figure 4:
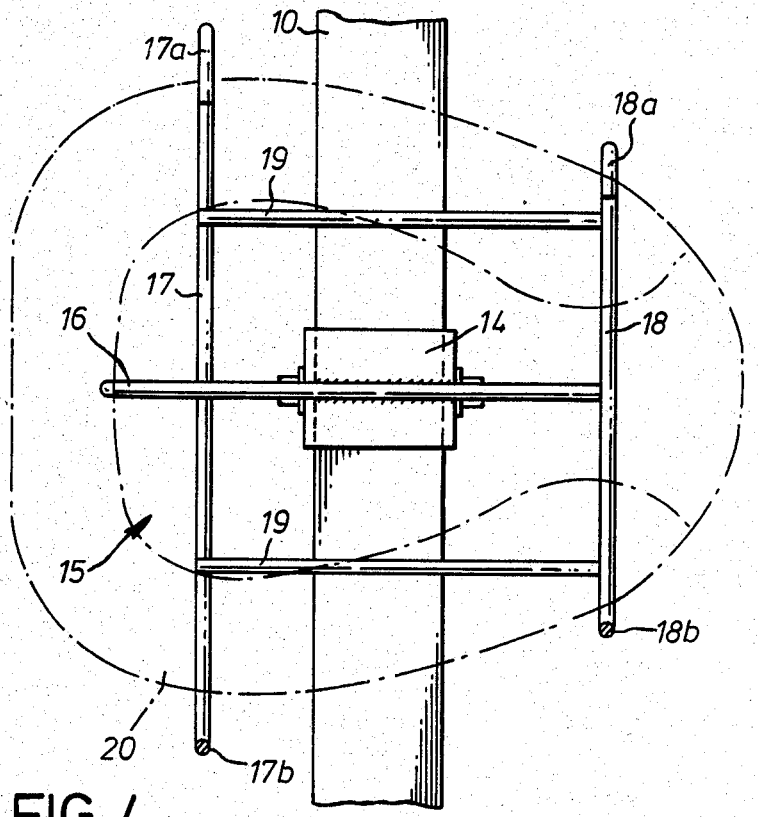
FIG. 4 is a view taken in the direction of arrow IV of FIG. 3.
Figure 5:
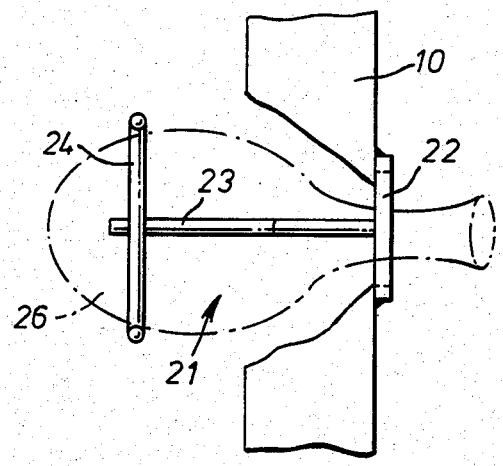
FIG. 5 is a plan view showing the location of a urine bottle in part of the cradle of FIGS. 2 to 4, a shaft being shown cut-away.

Located within the washing chamber 6 is a transverse shaft 10 rotatably mounted in opposite side walls 6*a*, 6*b* of the chamber 6 by means of bearings 11 and 12 and rotatable by means of an electric motor 13. As shown the shaft 10 has a square section but it could be of circular or other desired section. Secured to the upper face of the shaft 10 by a saddle 14 is an upper part 15 of a cradle comprising, as shown in FIGS. 2, 3 and 4, a central rearwardly extending member 16, a large generally U-shaped member 17 at the front end, a smaller generally U-shaped member 18 at the rear end and two bars 19 coupling the U-shaped members 17 and 18 together. Each U-shaped member 17, 18 has the free upper ends 17*a*, 18*a* of its side arms 17*b*, 18*b* turned inwardly and is of a size such that a bed pan 20 of standard size inserted thereinto as shown in FIG. 4, will have its forward end projecting beyond the smaller U-shaped member 18, its rear end projecting rearwardly beyond the U-shaped member 17 and its side walls in contact with the upstanding side arms 17*b*, 18*b* of the U-shaped members 17 and 18 such that it rests in the upper part 15 of the cradle in an approximately horizontal orientation as shown in FIG. 3.

Beneath the shaft 10, the cradle 15 is formed as a plurality of urine bottle holders 21. FIG. 2 shows that there are three of these in the illustrated embodiment, each comprising a generally rectangular collar 22 with its upper side secured to the shaft 10, for example by welding, an angled stem 23 projecting from the lower side of the collar 22 and a generally U-shaped member 24 having a middle portion secured to the stem 23 and upwardly projecting side portions. The cradle 15 also includes, above the urine bottle holders 21, a single rail 25 projecting substantially the full width of the chamber 6 and secured to the shaft 10. It will be seen that a respective urine bottle 26 can be placed in each holder 21, so that a neck 27 of the bottle projects through the collar 22 and a body 28 of the bottle is supported on the cross piece of the U-shaped member 24 and is located by the upwardly extending side arms thereof in substantially the orientation of use, that is to say an orientation in which the contents of the bottle are not likely to be spilled.

Figure 6:
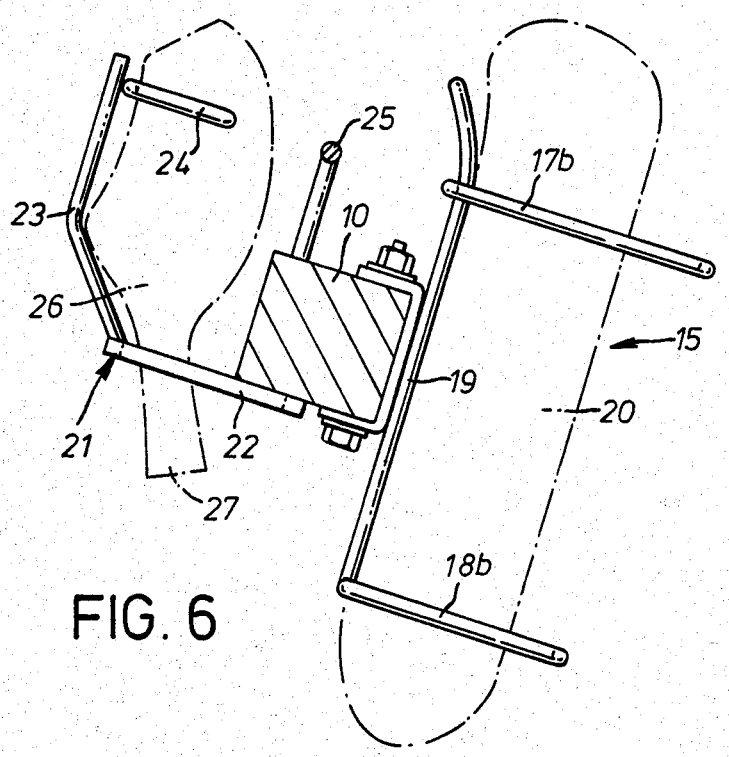
FIG. 6 is a view similar to FIG. 3 but showing the cradle rotated to an emptying and washing orientation.

By means of the motor 13, the shaft 10 can be rotated in a clockwise direction as viewed in FIG. 3 through an angle of 110°, thereby moving the cradle 15 to the position shown in FIG. 6. During movement of the cradle 15 between the positions of FIGS. 3 and 6, the contents of the bed pan 20 and urine bottles 26 will fall under the force of gravity into the outlet pipe 7 of the chamber 6. To assist spillage of the contents of the bed pan and to ensure that the contents of the bed pan are discharged from the water trap 8 of the outlet pipe 7 into the waste pipe 9, a water inlet 29 is provided in a top wall 30 of the chamber 6 and is controlled by a solenoid valve which is opened when the shaft 10 has rotated 45° from the initial position, as shown in FIG. 8, thereby to form a waterfall 31, as shown in FIGS. 8 and 9. At the same time, a water inlet 32 in a rear wall **6*c* of the chamber 6 is opened to form a curtain of water 33 on a wall portion 34 at the rear lower part of the chamber 6. The combined effects of the water inlets 29 and 32 which are supplied from a header tank 2*a* located within an upper part of the cabinet 2, is to provide a considerable downward flow of water, for example of the order of two gallons in the space of two to three seconds, such that solids will be forceably flushed from the bed pan 20 and through the water trap 8 and so that the trap 8 will not become clogged by toilet paper or a paper cover used to cover the bed pan 20** while carrying it to the machine.

The shaft 10 continues to rotate from the position of FIG. 8 to rotate the bed pan 20 and urine bottles 26 to the orientation of FIG. 6, that is to say 110° from the initial loading position, and in the orientation of FIG. 6, the bed pan 20 is washed by a hot water jet emanating from a water inlet 35 in the back wall **6*c* of the chamber 6 and the urine bottles 26 are washed internally by jets of hot water directed upwardly into the necks 27 thereof from three nozzles 35*a* mounted in a front wall of the chamber 6 to ensure that they are throughly cleansed. The three hot water nozzles 35*a* are fed by a water pump 35*b* driven by an electric motor. A steam generator 2*b* then supplies a steam nozzle 35*c* to effect a steam disinfection cycle. The steam cycle is initiated by a cam controller, which cam controller also controls the energisation of the motor 13 to rotate the cradle 15 following closing of the door, the opening of the solenoid valve to feed the cold water flushes from the water inlets 29 and 32 and the hot water jets from the nozzles 35*a* supplied by the water pump 35*b*. After the steam cycle has been completed with the temperature of the bed pan and urine bottles raised to a minimum of 80° C. and maintained at that temperature for at least one minute, cold water can again be supplied through the water inlets 29 and 32 to cool the bed pan 20 and urine bottles 26 during rotation of the cradle 15 from the position of FIG. 6 back to the position of FIG. 3**.

Preferably the door 3 is opened and closed by a reversible electric drive motor which can, for example, apply a force to an angled arm rigid with the door and projecting within the cabinet 2.

Since the operator, when approaching the machine, is already considered to have contaminated hands due to handling of the bed pan or urine bottle, it is desirable that the operator should not be required to touch any surfaces of the machine so that such surfaces do not become contaminated. The cabinet of the machine may therefore be provided with a pressure pad 36 on which the operator can place a foot to apply pressure after the bed pan and urine bottle have been inserted into the machine washing chamber 6 through the access opening 5. The door 3 will then close and the washing cycle will either be automatically initiated or if preferred can be separately initiated by the operator again applying pressure to the pressure pad 36.

The door 3, as shown in FIGS. 10 and 11, has an outer larger portion **3*a* and an inner smaller portion 3*b*, which smaller portion 3*b* in a closed position of the door 3 projects inwardly into the access opening 5 of the chamber 6. A peripheral seal 37 is provided on the outer portion 3*a* adjacent its junction with the inner portion 3*b*, the seal 37 pressing against the adjacent face 2*c* of the cabinet 2 in the closed position of the door. It will be seen from FIG. 11 that a lower front wall portion 38 of the chamber 6 extends downwardly from the upper edge of the portion 2*c*. As shown in FIG. 11 but omitted from FIG. 1, the outer part 3*a* of the door has a trough 39 at its inner lower edge which trough 39 will collect condensate water running downwardly on the inside face of the portion 3*b* of the door and the seal 37 when the door is in an open position. A flexible hose 40 provides a drain from the trough 39 to an outlet 41 in the wall portion 38 with a water trap 42 in the hose 40 and with a flexible flap 43 covering the outlet 41 so that liquids and gases from within the washing chamber 6 cannot pass back upwardly through the hose 40. The inner portion 3*b* of the door has a curved lower edge 44 to assist run-off of condensation from the inside of the door onto the vertical face of the adjacent seal 37 and into the trough 39. The hose 40 is secured to the door 3 adjacent the pivot axis 4** of the door to minimise movement of the hose during opening and closing movements of the door.

If, due to malfunction of the steam cycle, the recommended disinfection temperature of 80° C. is not reached and maintained as sensed by a sensor 45 in the wash chamber 6 then, by way of an alarm circuit a light, preferably a flashing light, is illuminated on an indication panel **45*a* of the cabinet 2** to indicate that the machine has malfunctioned and that a service engineer should be called. In the event of such malfunction, the door is not opened at the end of the cycle so that bed pans and urine bottles within the machine which have been washed but not disinfected cannot inadvertently be removed from the machine and re-used with the possibility thereby of cross-infecting other patients, until the fault in the steam cycle has been corrected by the service engineer and the machine recylced to disinfect the bed pan and urine bottles.

The cradle 15 can receive, as an alternative to the bed pan 20 and three urine bottles 26 shown in FIG. 2, various other ward utensils, such as vomit bowls and kidney dishes. By providing the machine with a greater width dimension but of substantially the same depth from front to rear, and also providing a modified cradle, two bed pans 20 can be accommodated side by side above the shaft 10 and up to six urine bottles can be accommodated beneath the shaft 10.

Referring now to FIGS. 12 to 20, a bed pan and urine bottle washing and disinfecting machine 50 has a cabinet 52 with an access opening 53 therein leading to a washing and disinfecting chamber which can substantially correspond to the chamber 6 of the machine 1 of the embodiment of FIGS. 1 to 11. The machine 50 of FIGS. 12 to 20 has a vertically sliding door 54 to close the access opening 53. In the embodiment described, the door 54 is raised to an open position and lowered to a closed position in which it obstructs the access opening 53 but it will be appreciated that an alternative embodiment is equally possible, that is to say where the door is lowered to a position below the opening 53 to allow access to the opening and is raised to its closed position.

Figure 12:
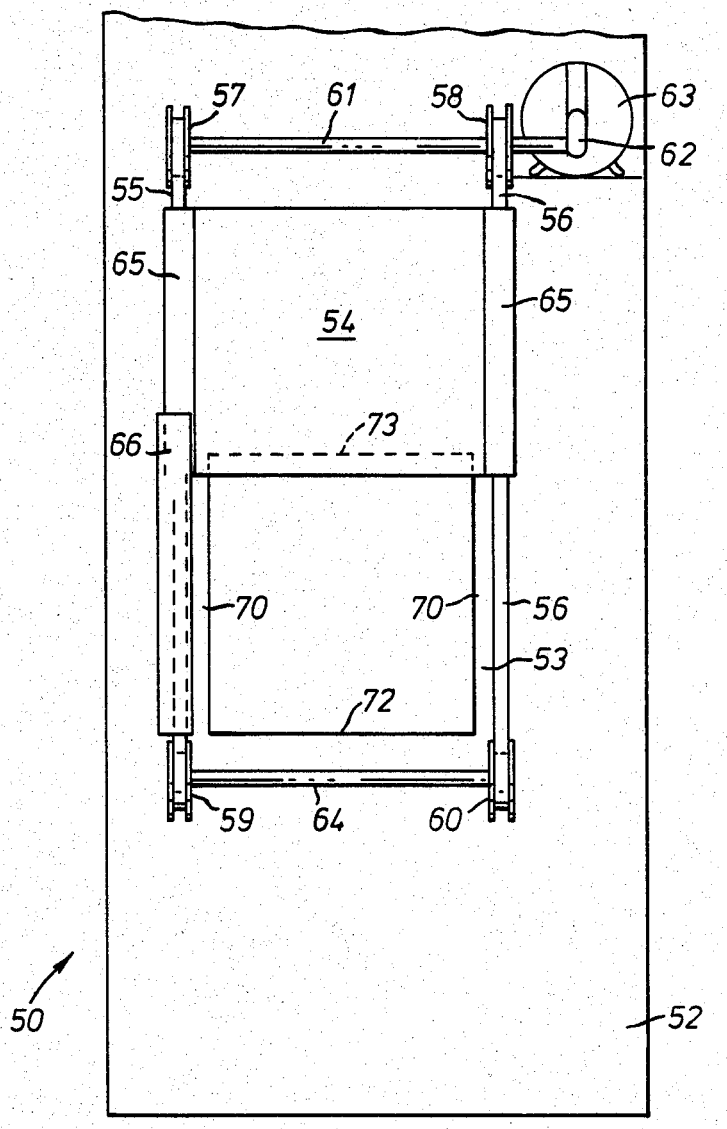
FIG. 12 is a schematic elevation of a second embodiment of a bed pan and urine bottle washing and disinfecting machine according to the invention.
Figure 13:
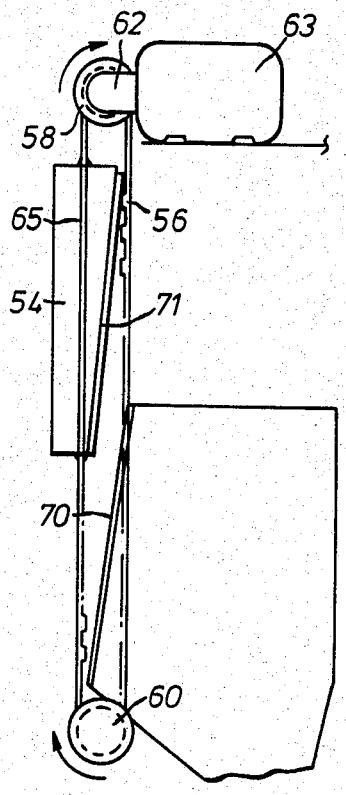
FIG. 13 is a side elevation corresponding to FIG. 12 showing a door moving into a fully open position.
Figure 14:
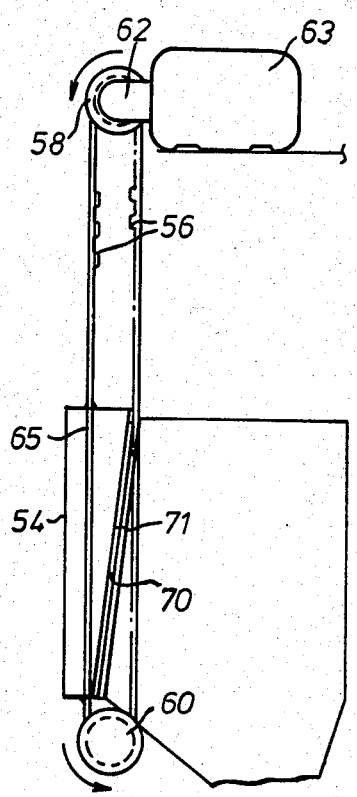
FIG. 14 is a view similar to FIG. 13 showing the door moving into a fully closed position.
Figure 15:
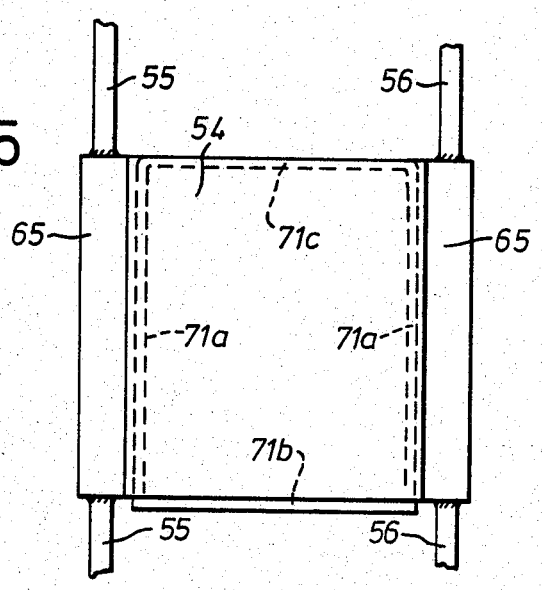

The door 54, as can be seen from FIGS. 13, 14 and 17, is wedge shaped with a greater thickness at the upper edge than at the lower edge. A first end of each of a pair of toothed drive belts 55, 56 are attached to the upper edge of the door 54 and the belts pass over upper pulleys 57, 58 and around lower, idler pulleys 59, 60 and have their other ends attached to the lower edge of the door 54. The pulleys 57, 58 are rigidly secured on a shaft 61 and the shaft 61 can be driven by way of a worm and wheel drive 62 by an electric motor 63. If desired the idler pulleys 59, 60 can also be toothed pulleys and can be securely mounted on a shaft 64 or rotatable on the shaft 64. By rotating the motor 63, the door can be raised or lowered. At each of its lateral sides the door 54 has a projecting flange 65 which cooperates with a respective guide rail 66 (only one of which is shown in FIG. 12) by engaging in a groove 67 thereof, the guide rails 66 being bolted to angle members 68 of a machine frame which also mounts the washing chamber and panels to form the cabinet 52, by bolts which pass through elongate apertures 69, FIG. 20, whereby the guide rails 66 are adjustable in position towards and away from the front face of the cabinet 52.

At the sides of the access opening 53, the adjacent portion of the wall of the washing chamber of the machine projects outwardly to form a face 70, with which face 70 a cooperating flexible seal 71 on the door cooperates in the lower, closed position of the door. The seal 71 is a peripheral seal, as can be seen from FIG. 15, with two lateral side portions **71*a* which cooperate respectively with the faces 70, a lower portion 71*b* which cooperates with a sill 72 formed by the wall of the washing chamber at the lower edge of the access opening 53 and an upper portion 71*c* which cooperates with a face 73 of the wall of the washing chamber at the upper edge of the access opening 53**.

It would of course be possible if preferred to provide the resilient seal on the faces 70, 72 and 73 of the wall of the washing chamber so that the seal was static and cooperated with the moving door rather than having a seal mounted on the moving door to cooperate with static faces of the washing chamber. Due to the toothing on the belts 55, 56 and the worm and wheel drive 62, the door 54 will be locked in the position in which it is in when the motor 63 is de-energised. Thus manual opening of the door is not possible and a mechanical lock to prevent manual opening is not therefore required. The electric motor could be replaced by other drive means such as a hydraulic or pneumatic motor if preferred. FIG. 12 shows the machine in its normal position of rest with the door 54 in a raised position so that used bed pans and urine bottles can be inserted through the access opening 53 and located on the cradle which is provided within the washing chamber as described with reference to FIGS. 1 to 11 but not shown in FIGS. 12 to 20. By operation of a foot control, the electric motor 63 can then be energised to drive the worm drive 62 and rotate the shaft 61 and the pulleys 57, 58 to pull the door 54 into the lowered closed position. The guide rails 66 are so adjusted on installation of the machine that as the lower portion **71*b* of the seal 71 moves into abutment with the sill 72, the side portions 71*a* of the seal 71 are, due to the wedge shape of the door, brought into sealing engagement with the cooperating faces 70 at the sides of the access opening 53 and the upper member 71*c* of the seal 71 seals against the face 73 at the upper edge of the access opening 53 thereby to seal the door all round the access opening 53. The motor 63 is then de-energised while the machine effects its washing and disinfection cycle. At the end of the washing and disinfecting cycle, the electric motor 63 is energised for rotation in an opposite direction to raise the door to the open position of FIG. 12** and allow the washed and disinfected bed pans and urine bottles to be removed.

A sliding door 54 as described can have the advantages that opening and closing of the door requires no manual effort on behalf of the operator, operation can be substantially silent, the seal 71 can have a long life since it is not subjected to large impact forces such as those which arise when a pivoted door is banged closed and the door projects only a very small distance from the front of the machine in both the open and the closed position whereby the machine of FIGS. 12 to 20 can be housed in a relatively small space.

Preferably the door 54 is hollow and filled with high-density heat resistant foam or similar insulating material which prevents the outer surface of the door from becoming hot through conducted heat from the washing chamber. What is claimed is:

1. A bed pan and urine bottle washing and disinfecting machine having a wash chamber, an opening providing access to the interior of said wash chamber, a generally wedge-shaped door having a lower edge of lesser thickness than an upper edge thereof, said door slidably mounted in guide rails provided at positions laterally of said door, said guide rails extending substantially vertically, said door having an inner face which slopes downwardly outwardly and flanges formed by wall portions of said wash chamber at positions laterally of said access opening sloping downwardly outwardly with the same angle of inclination as said inner face of said door such that said inner face and said flanges cooperate to wedgingly close said access opening, and means to seal said door around said access opening as said door moves into a closed position.

2. A bed pan and urine bottle washing and disinfecting machine having a wash chamber, an opening providing access to the interior of said wash chamber, a generally wedge-shaped door with the lower edge of said door of lesser thickness than the upper edge of said door to provide a sloped inner face cooperating with sloped wall portions of said wash chamber to wedgingly close said opening as said door moves into said closed position, said door being slidably mounted in guide rails provided at positions laterally of said door for movement in a substantially vertical plane, said guide rails extending substantially outwardly, flanges formed by wall portions of said wash chamber at positions laterally of said access opening and sloping downwardly outwardly with the same angle of inclination as said inner face of said door, and sealing means provided to seal said door around said access opening as said door moves in a closed position.

* * * * *